United States Patent [19]

Sparlin

[11] 4,062,403

[45] Dec. 13, 1977

[54] PUMP-DOWN SAND WASHING TOOL

[75] Inventor: Derry D. Sparlin, Ponca City, Okla.

[73] Assignee: Continental Oil Company, Ponca City, Okla.

[21] Appl. No.: 705,736

[22] Filed: July 15, 1976

[51] Int. Cl.[2] ..... E21B 37/00

[52] U.S. Cl. ..... 166/156; 134/166 C; 166/222; 166/312; 175/67

[58] Field of Search ..... 166/156, 312, 222, 223; 175/67, 215; 134/166 C, 167 C, 168 C, 169 C, 24

[56] References Cited

U.S. PATENT DOCUMENTS

| | | | |
|---|---|---|---|
| 1,859,490 | 5/1932 | Atkinson | 175/67 X |
| 3,279,543 | 10/1966 | Yetman | 166/312 X |
| 3,464,495 | 9/1969 | Sparlin | 166/312 |

*Primary Examiner*—Ernest R. Purser
*Assistant Examiner*—William F. Pate, III
*Attorney, Agent, or Firm*—A. Joe Reinert

[57] ABSTRACT

An improvement in a pump-down tool for use in sand washing operations is provided. The pump-down tool includes a tubular member having a locomotive member positioned thereabout and a fluid passageway positioned therethrough and a sand washing tool positioned in fluid communication with the lower end of the tubular member as positioned for use. The well has positioned therein a first and second tubing member with the first and second tubing members being in fluid communication at a junction near their lower ends so that the pump-down tool may be urged along the length of the first tubing member toward the junction by pumping fluid sequentially through the first tubing member, the junction and the second tubing member. The tool is recovered by pumping fluid in the opposite direction. The improvement comprises; positioning a slideably mounted locomotive means about the lower portion of the sand washing tool as positioned for use with the locomotive means including means for positioning the sand washing tool at an angle of up to about 5° from the axis of the first tubing member.

7 Claims, 4 Drawing Figures

PUMP-DOWN SAND WASHING TOOL

This invention relates to pump-down tools for use in oil wells and the like.

This invention more particularly relates to pump-down tools for use in sand washing operations and the like.

In recent years there has been increasing interest in the oil industry in producing hydrocarbon fluids from subterranean formations beneath the oceans. Such sub-sea completions are considerably more expensive than similar wells drilled on land and as a result a continuing effort has been directed to attempts to minimize the cost of the production of hydrocarbon fluids from such wells. Normally the operation of the wells is conducted from offshore platforms and the like. In many instances it is desirable that the sub-sea wells be located at remote distances from the offshore platforms so that larger areas may be produced without the necessity for building platforms for each well.

The maintenance of such remotely located wells is difficult and as a result pump-down tools have been developed wherein a first and second tubing member are positioned in the well and extend to the bottom (or a desired intermediate zone) of the well and to the platform or a central control location. The first and second tubing members are joined near their lower ends by a junction commonly referred to as an H-member. In the operation of pump-down tools, the tool is placed in the first tubing member and fluid is then pumped sequentially through the first tubing member, the H-member and the second tubing member thereby moving the pump-down tool along the length of the first tubing member to a desired location. The pump-down tool is readily stopped at a desired location by positioning no-go devices at desired locations in the first tubing member. The no-go devices may be designed to permit the passage of certain tools and restrict the passage of other tools and the like as is well known to those skilled in the art. The use of pump-down tools for operations such as paraffin scraping, sand washing and the like is known to those skilled in the art as shown for instance in SPE preprint No. 2246 entitled "Advancements in Remote Completion and Operation of Underwater Satellite Wells" by Childers and Longley presented at the fall meeting in 1968 and as further shown in a publication No. OEC 5113 published by the Otis Engineering Corporation of Dallas, Texas.

In the use of such tools for sand washing a typical operation comprises; positioning a sand washing tool on the lower portion of a tubular member including locomotives so that the sand washing tool and locomotives are readily moved to the lower portion of the first tubing member and thereafter fluid injection is commenced through the sand washing tool while the locomotives continue to urge the sand washing tool further into the well until a no-go device in the first tubing member engages a no-go stop on the locomotive member after which the injection of fluid is continued through the sand washing tool until the fluid recovered through the second tubing member is clear. In such operations a continuing problem has been the occurrence of sand bridging and the like. The clearance between the outer diameter of the sand washing tool and the inner diameter of the first tubular member is normally small and as a result sand bridging tends to occur with the resultant hang ups of the sand washing tool in the well which requires pulling the tubing string and extensive tool recovery efforts.

In an effort to circumvent this problem, improved methods have been sought whereby sand bridging is minimized during such operations. It has now been found that such an improvement is accomplished by positioning a slideably mounted locomotive means about the lower portion of the sand washing tool as positioned for use with the locomotive means including a means for positioning the sand wasing tool at an angle of at least about 0.02° from the axis of the first tubing member.

DESCRIPTION OF PREFERRED EMBODIMENTS

In the following description of the drawings the same numbers will be used throughout to refer to the same or similar components.

Figure 1:
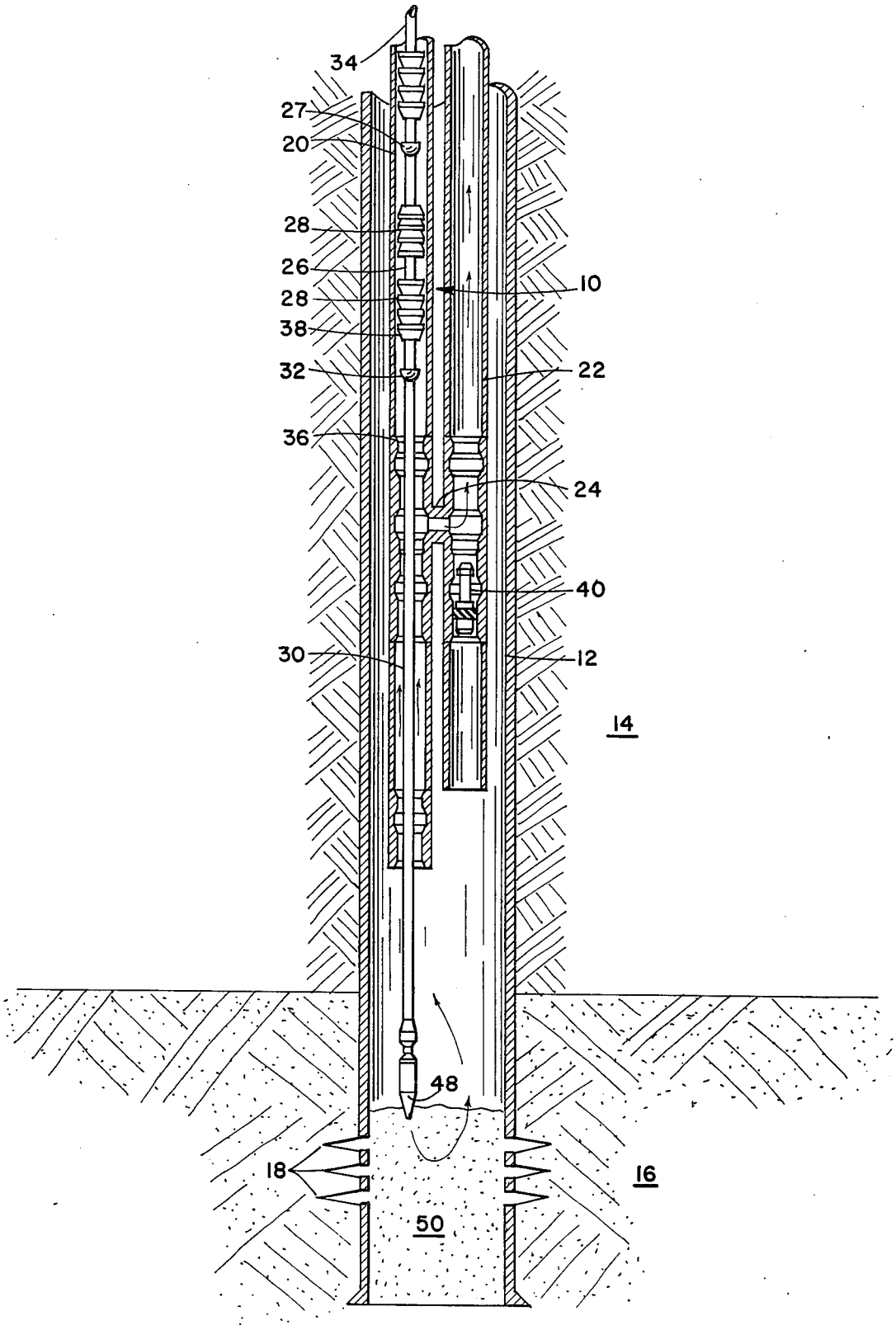
FIG. 1 is an embodiment of a typical prior art pump-down sand washing tool including locomotives and a sand washing nozzle.

In FIG. 1 a pump-down tool 10 is shown in position in wellbore 12 which penetrates a subterranean formation 14 and a hydrocarbon bearing formation 16 by way of perforations 18. Tool 10 includes a tubular member 26 having locomotives 28 positioned thereabout and a sand washing tool 30 positioned as shown. A first tubing member 20 and a second tubing member 22 are positioned in wellbore 12 with a junction 24 (H-member) near their lower ends. Tubular member 26 including locomotives 28 is positioned in first tubing member 20 with sand washing tool 30 being joined by a ball joint 32 to tubular member 26. A second tubular member 34 is shown joined to tubular member 26 by a rotatable joint 27 and includes locomotives. Sand washing tool 30 is shown in contact with sand 50 with a no-go fitting device 36 being positioned in first tubing member 20 and a no-go fitting 38 being positioned about tubular member 26. A plug 40 is used to plug the lower end of second tubing member 22.

In the operation of the device shown in FIG. 1 tool 10 is pumped through first tubing member 20 by placing tool 10 in first tubing member 20 and thereafter pumping fluid through first tubing member 20, junction 24 and second tubing member 22 to urge tool 10 through first tubing member 20 and into the position shown. Pumping is then continued with the pumped fluid passing through tubular member 26 and sand washing tool 30 to loosen and flush sand 50 from wellbore 12 and upwardly between the outer diameter of sand washing tool 30 and the inner diameter of first tubing member 20 then through junction 24 and up second tubing member 22. Clearly, the points of closest restriction are in the annular space between the outer diameter of sand washing tool 30 and the inner diameter of first tubing member 20. Sand bridging problems frequently occur in this area as larger chunks of sand or the like are dislodged.

The fluid injected may be water, brine, oil or the like and in many instances is a viscous fluid such as gelled water, brine, oil, water-oil emulsions, oil-water emulsions, foamed water, gas, viscous crude oil, refined oils and the like. Such materials are known to those skilled in the art for use in sand washing operations and need not be discussed further.

Figure 2:
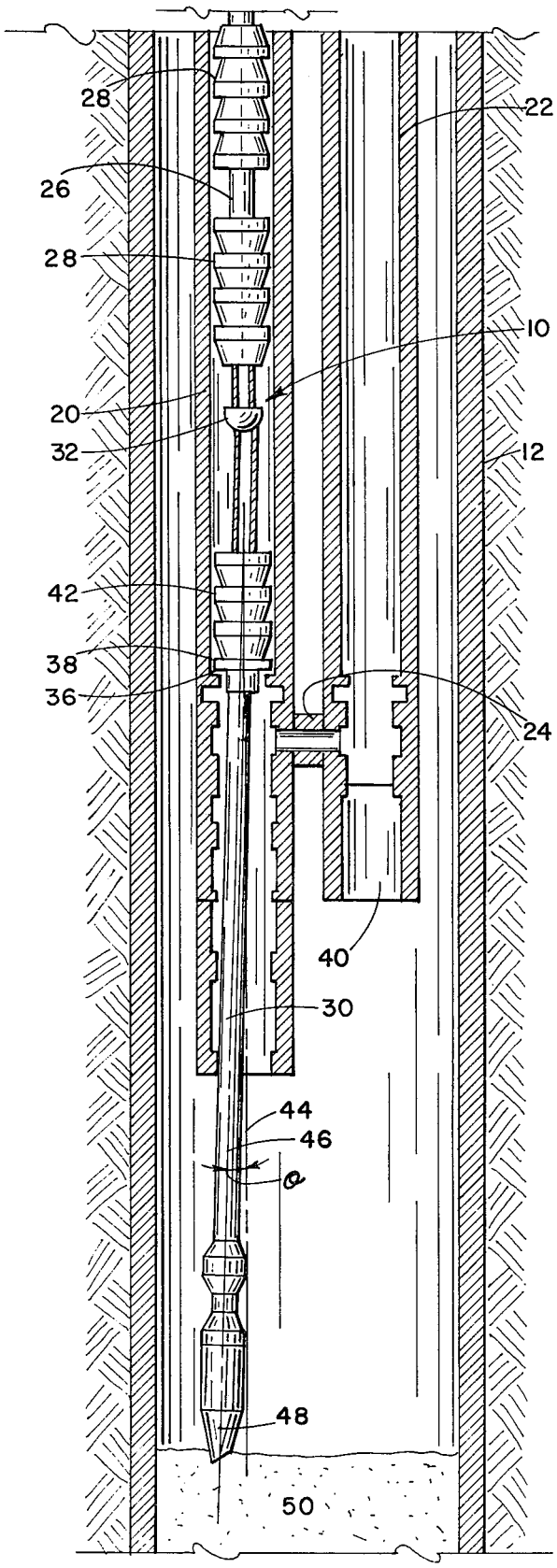
FIG. 2 is a view of a sand washing tool similar to that of FIG. 1 but including an embodiment of the present invention.

FIG. 2 shows an embodiment of the present invention wherein sand washing tool 30 is joined to tubular member 26 by a joint 32 which is desirably a rotatable joint such as a ball joint or the like which allows fluid flow therethrough. A slideably mounted locomotive means 42 is positioned near the lower end 48 of sand washing tool 30. As sand washing tool 30 encounters sand or the like, its progress downwardly through first tubing member 20 is impeded and washing is begun. By the improvement of the present invention, slideable locomotive 42 is mounted on sand washing tool 30 at an angle $\theta$ of at least 0.2° and up to about 5.0°. Desirable $\theta$ is from about 0.2 to about 2.0°. When slideable locomotive 42 engages no-go device 36 by no-go fitting 38 positioned on slideable locomotive 42 further downward movement of sand washing tool 30 is prevented and sand washing is performed with sand washing tool 30 being deflected to one side of the inner diameter of first tubing member 20 thus creating a larger annular space between the outer diameter of sand washing tool 30 and the inner diameter of fist tubing member 20.

In the operation of the device shown in FIG. 2, pumping is continued after sand washing tool 30 encounters sand 50 and as sand and the like is flushed upwardly through the annular space between the outer diameter of sand washing tool 30 and the inner diameter of first tubular member 20 through junction 24 and second tubular member 22, a continuing downward pressure is exerted upon sand washing tool 30 by locomotives 28 positioned on tubular member 26. Slideably mounted locomotive 42 is maintained in position by a downward pressure thereon generated by fluid which bypasses locomotives 28 and maintains a downward pressure on slideably mounted locomotive 42. Such maintains slideably mounted locomotive 42 in position and causes sand washing tool 30 to be deflected as shown. A larger annular space has been provided and sand bridging and the like is minimized.

In some instances sand washing tool 30 may be deflected toward the wall of first tubing member 20 nearest second tubing member 22 and since such is less desirable the positioning of sand washing tool 30 as shown in FIG. 2 is facilitated by generating a short surge of back pressure through second tubing member 22 after sand washing tool 30 is in position. Such pressure surges should be of a duration short enough so that no substantial upward movement of sand washing tool 30 occurs. Such is possible since locomotive 42 is slideably mounted and exerts substantially no lifting effect on sand washing tool 30 until it reaches joint 32.

A substantial improvement is achieved regardless of the direction in which sand washing tool 30 is deflected since sand bridging occurrences are more frequent in the area beneath junction 24 than in junction 24 or second tubing member 22.

Figure 3:
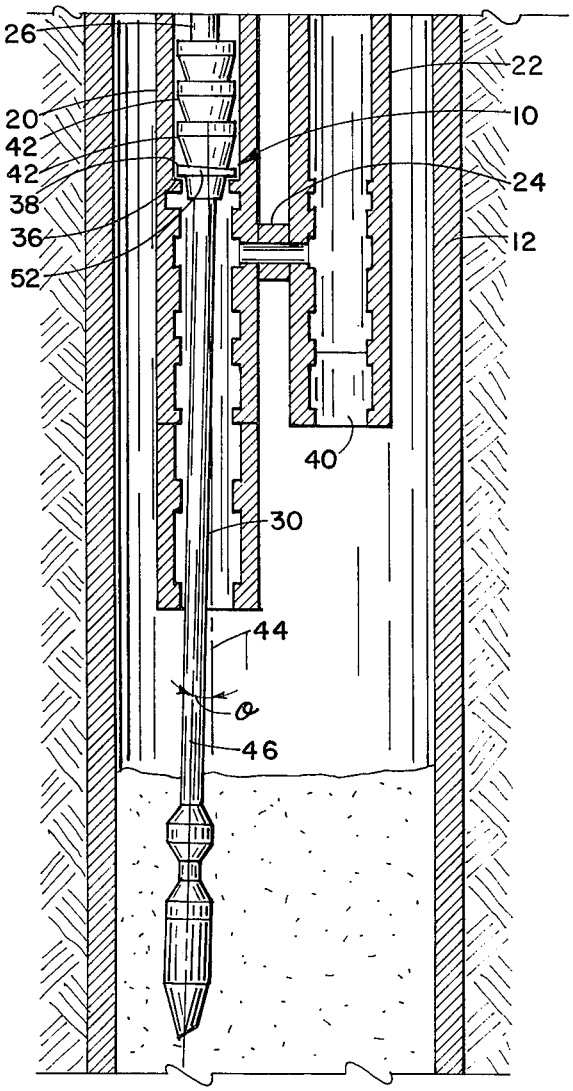
FIG. 3 is a cross-sectional view of a further embodiment of the improvement shown in FIG. 2.

In a further embodiment shown in FIG. 3 an asymmetric washer 52 is positioned beneath locomotive 42. In this embodiment locomotive 42 is slideably mounted on sand washing tool 30 and has an axis which substantially coincides with axis 46 of sand washing tool 30 as opposed to the embodiment shown in FIG. 2 wherein the axis of locomotive 42 substantially coincides with the axis 44 of first tubular member 20. In the embodiment shown in FIG. 3 the deflection of sand washing tool 30 is accomplished by the junction of an asymmetric washer 52 with no-go fitting device 36 which is formed to matingly join with locomotive 42 and deflect sand washing tool 30 by tilting the axis of locomotive 42 to an angle $\theta$ of up to about 5° from axis 44 of first tubular member 20. Desirably the angle between the axis 46 of sand washing tool 30 and the axis 44 of first tubing member 20 varies from about 0.2° to about 2.0°.

The operation of the apparatus shown in FIG. 3 is substantially the same as the operation of the apparatus shown in FIG. 2.

Figure 4:
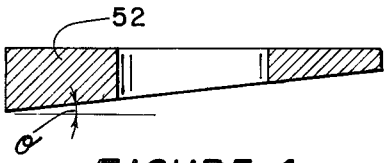
FIG. 4 is a cross-sectional view of the asymmetric spacer used in the embodiment shown in FIG. 3.

FIG. 4 is a cross-sectional view of an asymmetric washer 52 which is positioned on the lower portion of slideably mounted locomotive 42 in FIG. 3 to deflect sand washing tool 30. Asymmetric washer 52 desirably has surfaces which are angularly disposed at an angle of $\theta$ of at least 0.02 ° and preferably from about 0.2° to about 2.0°.

Slideably mounted locomotive 42 is readily mounted in a slideable fashion on a sand washing tool 30 by placing a resilient plastic sleeve over sand washing tool 30 with locomotive 42 being positioned thereon or the like. Numerous such mounting devices are known to those skilled in the art and need not be discussed further. Similarly sand washing tool 30 includes a sand washing nozzle 48 of types known to those skilled in the art. Desirably the lower end of nozzle 48 is tapered at an angle of about 10 to about 45° from perpendicular to the axis of tool 30. Preferably the angle is from about 15 to about 30.

Having thus described certain preferred embodiments of the present invention it is pointed out that the description of preferred embodiments is illustrative rather than limiting in nature and that many variations and modifications are possible within the scope of the present invention. It is anticipated that many such variations and modifications may be considered obvious or desirable by those skilled in the art upon a review of the foregoing figures and descriptions of preferred embodiments.

Having thus described the invention, I claim:

1. In a pump-down tool for use in sand washing operations wherein fluids are injected into a well, said tool including a first tubular member having a fluid passageway positioned therethrough and a sand washing tool means having a first locomotive means fixedly positioned thereabout positioned in fluid communication with the lower end of said first tubular member as positioned for use, and also including a second tubing member, said first and second tubing members being in fluid communication at a junction near their lower ends and said first tubing means having a stop means above the junction so that when placed in said first tubing member said sand washing tool is urged along the length of said first tubing member toward said junction to a point wherein said first locomotive means is above the junction by pumping fluids sequentially through said first tubing member, said junction, and said second tubing member; and is urged back along the length of said first tubing member toward the upper end of said first tubing member by pumping fluid in the opposite direction; the improvement comprising; a second locomotive means slideably mounted about the lower portion of said sand washing tool within said first tubular member as positioned for use at a locus below said first locomotive means but above said junction and said stop, said second locomotive means including means for positioning said sand washing tool such that its axis on its length projecting below the lower end of said first tubular member is at an angle 0.2 to 5.0° from the axis of said first tubing member and such that the axis of the length of said sand washing tool below said second locomotive means is substantially different from the axis of said first tubular member over the same length.

2. The improvement of claim 1 wherein said second slidably mounted locomotive means includes an asymmetrical spacer means positioned on its lower portion so that when said asymmetrical spacer is urged into contact with said stop positioned in said first tubing member above said junction said length of said sand washing tool projecting below said lower end of said first tubular member is urged into said angular relationship with said first tubular member.

3. The improvement of claim 2 wherein said spacer means comprises a washer means wherein the upper and lower sides of said washer vary from parallel by an angle of at least 0.2°.

4. The improvement of claim 1 wherein said sand washing tool means has a flexing portion in its length between the locus of the first locomotive means and the second slideably mounted locomotive means, such that the direction of the linear axis of the sand washing tool can vary from substantially parallel to the direction of the linear axis of the first tubular member to the direction of the length of the sand washing tool projecting below the lower end of the first tubular member.

5. The improvement of claim 4 wherein the flexing portion is a mechanical joint.

6. The improvement of claim 2 wherein said sand washing tool means has a flexing portion in its length between the locus of the first locomotive means and the second slideably mounted locomotive means, such that the direction of the linear axis of the sand washing tool can vary from substantially parallel to the direction of the linear axis of the first tubular member to the direction of the axis of the length of the sand washing tool projecting below the lower end of the first tubular member.

7. The improvement of claim 3 wherein said sand washing tool means has a flexing portion in its length between the locus of the first locomotive means and the second slideably mounted locomotive means, such that the direction of the linear axis of the sand washing tool can vary from substantially parallel to the direction of the linear axis of the first tubular member to the direction of the axis of the length of the sand washing tool projecting below the lower end of the first tubular member.

* * * * *